US006666462B2

(12) United States Patent
Bellehumeur et al.

(10) Patent No.: US 6,666,462 B2
(45) Date of Patent: Dec. 23, 2003

(54) BRAKE FOR INLINE SKATES

(75) Inventors: Alex R. Bellehumeur, Long Beach, CA (US); Ronald H. Powers, Costa Mesa, CA (US)

(73) Assignee: Alron, Long Beach, CA (US)

( * ) Notice: Subject to any disclaimer, the term of this patent is extended or adjusted under 35 U.S.C. 154(b) by 35 days.

(21) Appl. No.: 10/005,620

(22) Filed: Dec. 7, 2001

(65) Prior Publication Data

US 2003/0107194 A1 Jun. 12, 2003

(51) Int. Cl.[7] ..... A63C 17/14
(52) U.S. Cl. ..... 280/11.215
(58) Field of Search ..... 280/11.204, 11.211, 280/11.214, 11.215, 11.221, 842; 188/29, 17, 335; 301/5.3

(56) References Cited

U.S. PATENT DOCUMENTS

| | | | | | |
|---|---|---|---|---|---|
| 4,799,701 | A | * | 1/1989 | Lindau et al. | 280/87.041 |
| 5,088,748 | A | * | 2/1992 | Koselka et al. | 188/29 |
| 5,226,673 | A | | 7/1993 | Cech | |
| 5,232,231 | A | | 8/1993 | Carlsmith | |
| 5,351,974 | A | | 10/1994 | Cech | |
| 5,415,419 | A | | 5/1995 | Bourque | |
| 5,464,235 | A | * | 11/1995 | Goldman et al. | 280/11.221 |
| 5,758,885 | A | * | 6/1998 | Lowe | 280/11.214 |
| 5,769,433 | A | * | 6/1998 | Zorzi et al. | 280/11.214 |
| 5,803,468 | A | | 9/1998 | Petrucci et al. | |
| 5,882,019 | A | | 3/1999 | Pellegrini, Jr. et al. | |
| 5,897,170 | A | * | 4/1999 | Keleny | 301/5.3 |
| 5,908,197 | A | | 6/1999 | Struthmann et al. | |
| 5,984,323 | A | | 11/1999 | Daley | |
| 5,997,015 | A | | 12/1999 | Bellehumeur | |
| 6,039,330 | A | * | 3/2000 | Hoskin | 280/11.214 |
| 6,131,920 | A | * | 10/2000 | Roman et al. | 280/11.221 |

FOREIGN PATENT DOCUMENTS

| | | | | |
|---|---|---|---|---|
| DE | 101 07 152 A1 | * | 8/2002 | A63C/17/14 |
| FR | 2593713 | * | 8/1987 | 280/11.215 |
| WO | 96/36408 | * | 11/1996 | A63C/17/14 |

* cited by examiner

*Primary Examiner*—Frank Vanaman
(74) *Attorney, Agent, or Firm*—Edgar W. Averill, Jr.

(57) ABSTRACT

A brake assembly for inline skates. The assembly includes a brake arm which is supported by a wheel frame and can be moved between a free running position and a braking position. At least one wheel is a "braking wheel" to which a braking force may be applied. The braking wheel has a brake ring held by the wheel, which ring rotates with the wheel. The brake ring has a radially outwardly facing circular brake contact surface positioned so that it is contacted by the movable brake arm when the movable brake arm is in its braking position.

11 Claims, 3 Drawing Sheets

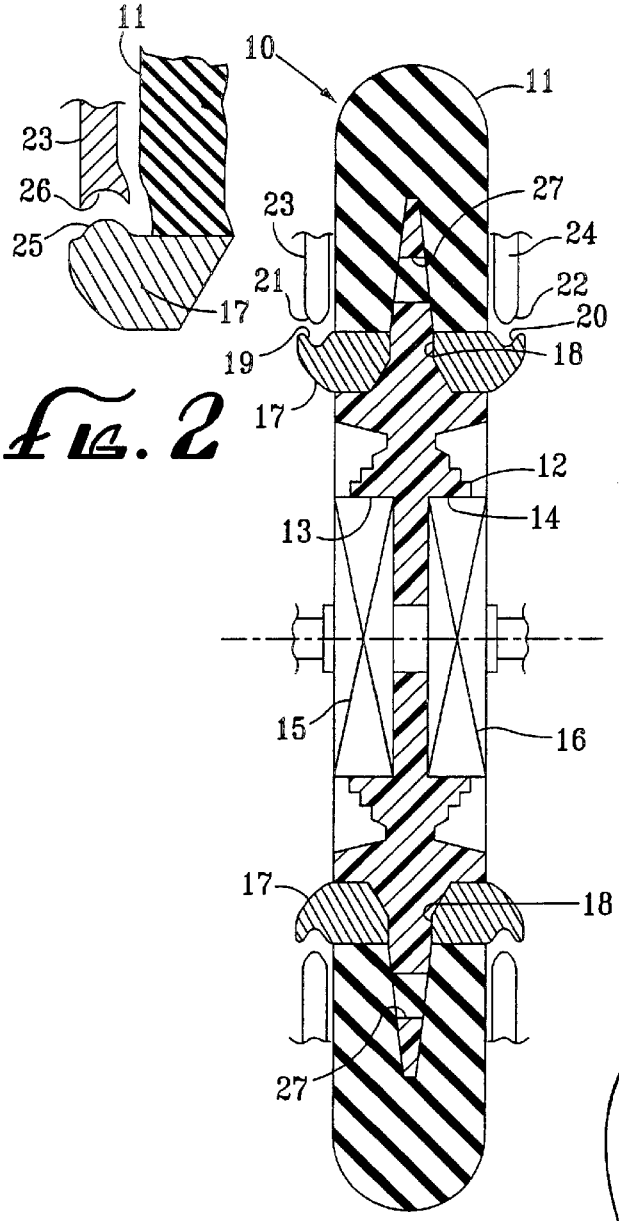
FIG. 2
FIG. 1
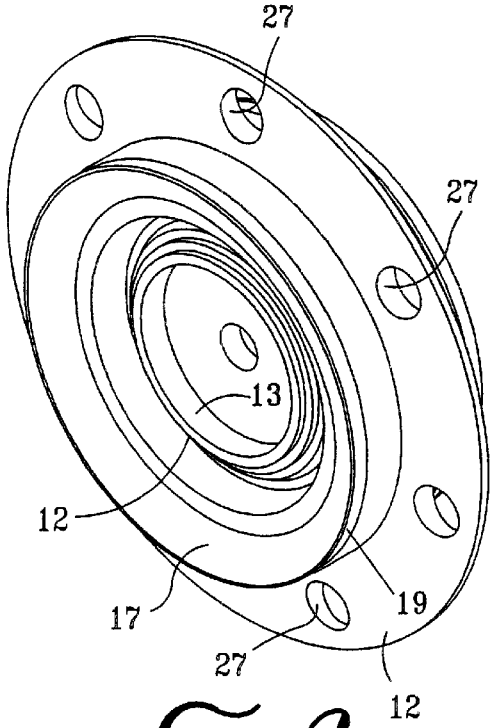
FIG. 3
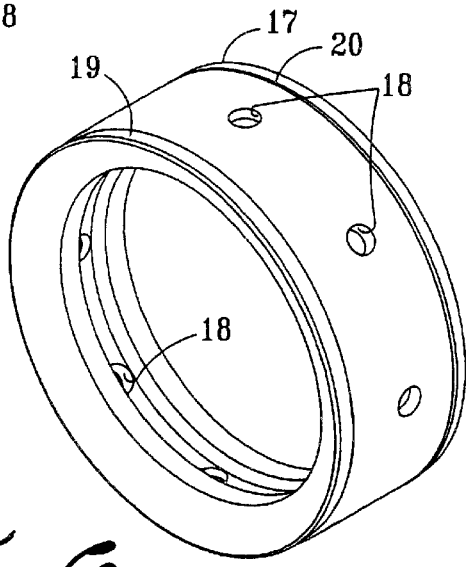
FIG. 6

BRAKE FOR INLINE SKATES

BACKGROUND OF THE INVENTION

The field of the invention is a braking system for inline skates. Inline skates are increasing in popularity, but a satisfactory system for slowing down the travel of such skates has been elusive. The most common approach is a brake pad which is positioned at the rear of the skate. When the skater wishes to slow down, he tips the boot portion rearwardly so that the pad contacts the skating surface and frictionally slows down the skater.

There have been numerous patents issued on braking systems for exerting a braking force on one or more wheels. One such patent is applicant's U.S. Pat. No. 5,997,015. A brake member 22 is pivotally held by the frame and has a curved forward brake surface 26 and a curved rear brake surface 27. These brake surfaces abut brake drum members 28 and 29 to cause a braking action when activated. It is preferably activated with the rearward pivoting of a horseshoe shaped member 15.

U.S. Pat. No. 5,226,673 utilizes a remote control which, as shown in FIGS. 10 and 11, cause a pad 145 to rub against a pad-engaging structure 165.

U.S. Pat. No. 5,232,231 shows a brake which is activated when the skater rocks the boot of the skate backward. This puts pressure on the heel of the boot, which is translated into pressure on the brake pads 30. These provide rolling resistance via drums 41 and tires 42.

U.S. Pat. No. 5,351,974, as shown in FIG. 18, utilizes a brake drum 252 contacted by brake pad 250 when the brake is actuated.

U.S. Pat. No. 5,415,419 shows in FIG. 5 a flexible horseshoe arrangement which wraps around a steel drum 46 carried by the wheels.

U.S. Pat. No. 5,803,468 shows a hydraulic fluid operated braking system which is controlled via a radio frequency transmitter. As shown in FIGS. 3 and 4, brake pads 49 are caused to move inwardly and contact web 39 to cause the wheel to cause a braking action for movement of the skate.

U.S. Pat. No. 5,882,019 shows in FIG. 2 a pair of brake pads 20A and 20B which contact discs 21A and 21B causing a braking action.

U.S. Pat. No. 5,908,197 utilizes a turning, non-circular rod 8 which causes a pair of brake shoes 9 to contact a pair of brake pads 16.

U.S. Pat. No. 5,984,323 shows in FIG. 4 a flexible horseshoe brake collar which causes the collar to rub against a brake drum.

None of the prior art designs have found wide acceptance in the inline skate field. Many of the designs are too elaborate and, thus, expensive and prone to defects. Other designs do not dissipate the heat generated by braking satisfactorily and a better design is needed.

BRIEF SUMMARY OF THE INVENTION

It is an object of the present invention to provide a brake for inline skates which is both inexpensive to manufacture and also is capable of dissipating the heat generated by the braking action.

The present invention is for a brake assembly for inline skates. The assembly has a movable brake arm supported by the wheel frame of the inline skates. The movable brake arm is movable between a pre-running position and a braking position. At least one braking wheel is supported by the wheel frame. The braking wheel has a rotating brake ring held by the wheel, which brake ring has an outwardly facing circular contact surface positioned so that it is contacted by a friction area of the movable brake arm when the movable brake arm is in a braking position and wherein the contact surface of the rotating brake ring has a brake pad surface thereon. Preferably, the brake contact surface on the rotating brake ring is shaped so that it positions the movable brake arm in a desired lateral location. A shape such as a concave shape on the brake ring and a mating convex shape on the brake arm is contemplated as is a V-shaped or cup-shaped configuration. Preferably, the rotating brake ring is molded into the hub portion of the wheel and preferably, is made from a brake pad material which tends to be more insulative than a movable brake arm fabricated from steel. Thus, the heat at the friction area between the movable brake arm and the rotating brake ring is carried away largely by the metal movable brake arm. The rotating brake ring may extend out of both sides of a braking wheel and there may be more than one braking wheel.

BRIEF DESCRIPTION OF THE DRAWINGS

FIG. 1 is a cross-sectional view of the brake assembly of the present invention.

FIG. 2 is an enlarged cross-sectional view of the brake arm contact area of the brake assembly of FIG. 1.

FIG. 3 is a perspective view of the hub portion and rotating brake ring of the brake assembly of FIG. 1.

FIG. 6 is a perspective view of the brake ring of the brake assembly of FIG. 1.

DESCRIPTION OF THE PREFERRED EMBODIMENTS

Figure 4:
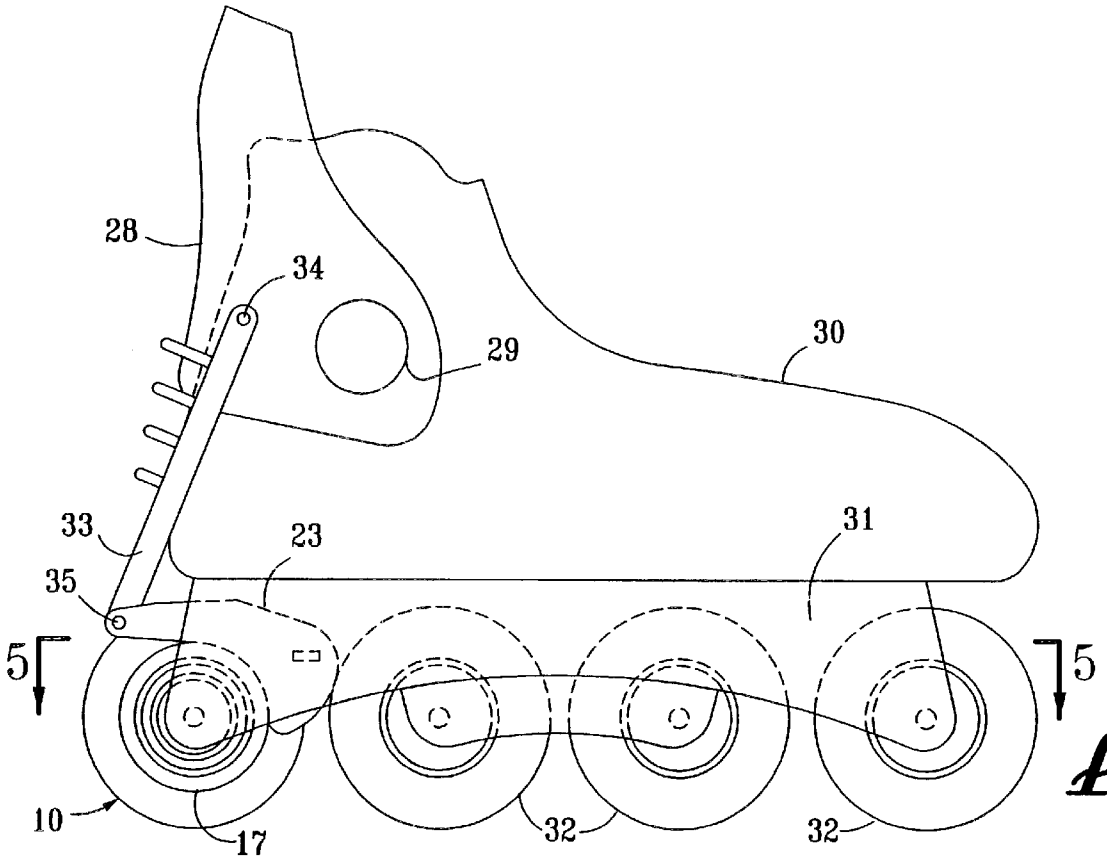
FIG. 4 is a top view of the braking assembly of the present invention showing a brake ring on each side of a wheel.

A wheel and brake ring portion of the brake assembly of the present invention is shown in cross-sectional view in FIG. 1. Wheel 10 has a tire 11 molded around a hub 12 which has a pair of bearing support cavities 13 and 14. These support cavities 13 and 14 support wheel bearings 15 and 16 in a conventional manner.

A brake ring 17 is molded into hub 12. Brake ring 17 is preferably injection molded from a ceramic or glass filled polymer having a set of openings 18 shown in FIG. 6 which help to hold it in hub 12. Brake ring 17 may be placed in the mold and the balance of hub 12 molded around it so that it becomes an integral part of hub 12. By forming brake ring 17 of a ceramic or abrasive-filled polymer, it is less heat conductive than a steel ring. A steel ring may, however, still be used if the hub and wheel are fabricated from a material which can withstand the heat generated by the brake assembly.

As shown in FIG. 1, brake ring 17 has a pair of generally V-shaped depressions 19 and 20. These mate with V-shaped projections 21 and 22 on brake arms 23 and 24. The function of the shaped depressions 19 and 20 and the projections 21 and 22 is to laterally align the brake arms 23 and 24 in the assembly so that they do not rub against the tire 11 or the frame.

Of course, the depressions and projections need not be V-shaped and a convex projection 25 is shown on brake ring 17 in FIG. 2 and a concave mating shape 26 is shown on brake arm 23. By shaping the contact area between the brake arm and the brake ring, the brake arm is not only aligned in the lateral position but also the contact area is increased as compared to the conventional flat contact area. It can be shaped to occupy an area which would normally be contacted by tire 11, as shown in FIG. 2.

Hub 12 with integrally molded brake 17 is shown in perspective view in FIG. 3 where it can be seen that the hub has a series of openings 27 which are useful in integrating the hub 12 with the tire 11. For instance, when a urethane tire is molded over the hub, the urethane headers openings 27 assist in the bonding of hub 12 with tire 11.

Figure 5:
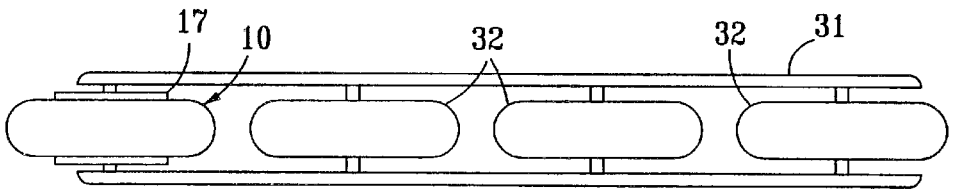
FIG. 5 is a top view taken along line 5—5 of FIG. 4.

A side view of an inline skate having a pair of brake arms acting only against the rear wheel is shown in FIGS. 4 and 5 of the drawings. Their generally horseshoe shaped member 28 is pivoted at pin 29 on boot 30. Boot 30 supports frame 31 which in turn rotatingly supports braking wheel 10 as well as free wheeling wheels 32. A link 33 is pivotally supported at the upper end at the pin 34 and at the lower end by pin 35. The action of the brake is analogous to that shown in applicant's U.S. Pat. No. 5,997,015, which is incorporated by reference herein. The brake may be on either the right and left side only of one or more wheels and a one-sided brake is shown in perspective view in FIG. 7, which also includes an adjustment feature. A threaded link 36 has a threaded shank 41 which screws into threaded opening 42 at the base of link 33. The link between link 33 and arm 23 is shortened by screwing threaded shank 41 into threaded opening 42. Conversely, the length is lengthened by unscrewing these two members relative to one another. The threaded link 36 is held in a fixed position by the connection of U-shaped connector 37 over opening 40 at the rear end 43 of brake arm 23. This is accomplished by screwing bolt 38 onto nut 39 through the openings 44 in threaded link 36 and opening 40 in brake arm 23.

Figure 7:
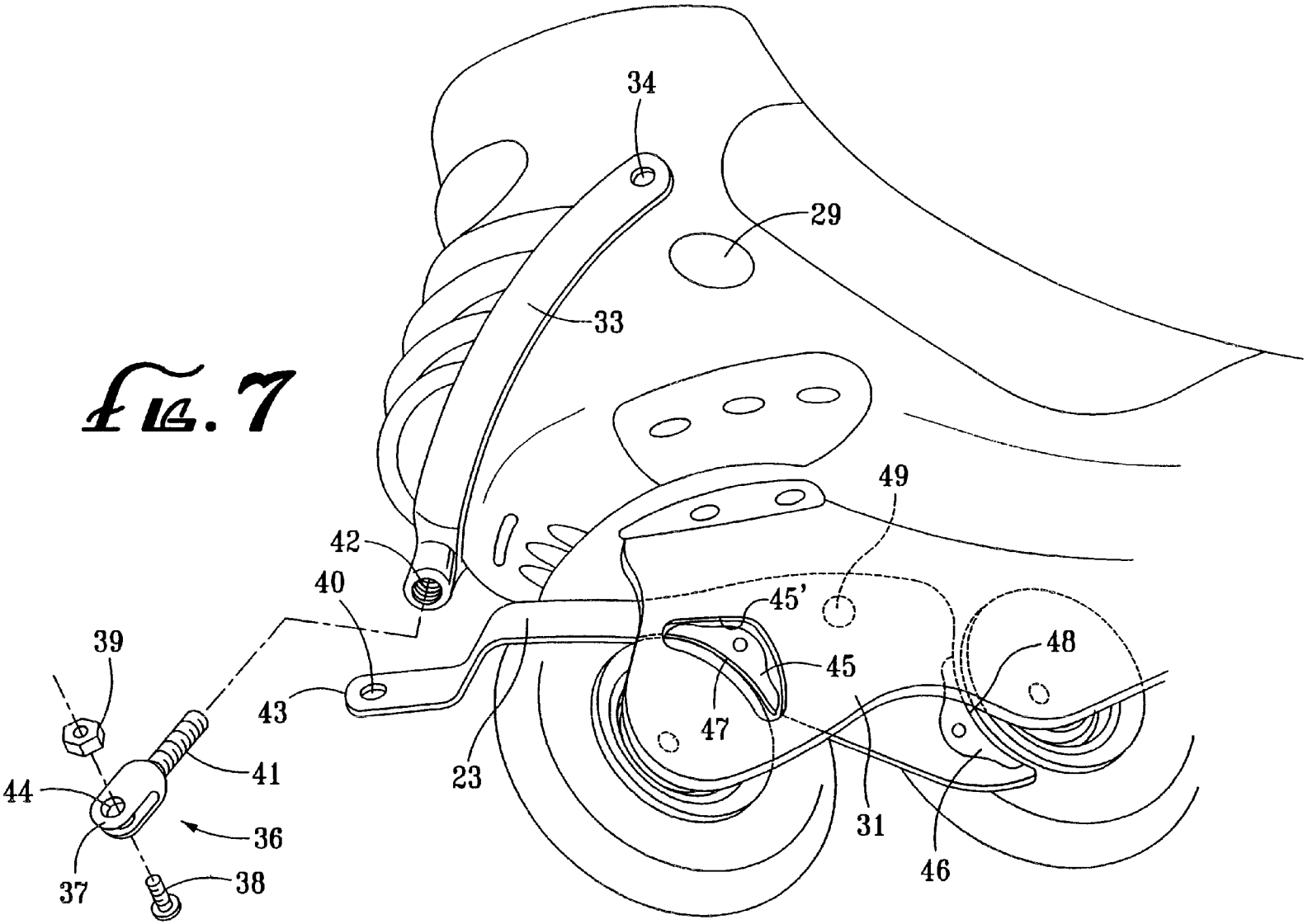
FIG. 7 is a perspective view showing an adjustable link of the brake assembly of the present invention.

Another feature is shown in FIG. 7, and that is the presence of removable and replaceable brake shoes 45 and 46. Removable support 45 and 46 hold brake pads 47 and 48, respectively. In this way, the brake pads can be replaced when worn. Brake shoe 45 can be removed through opening 45' in frame 41 The pivot pin which holds arm 23 in place is indicated by reference character 49 and is supported by frame 31.

It is also contemplated that brake ring 17 can be fabricated from steel or other material of construction and have an abrasive surface coated or otherwise affixed at the friction surface of the brake ring. When such friction surface becomes worn, the braking wheel is replaced to provide a fresh abrasive brake pad surface.

The result is a compact and yet easily operated braking system which provides much more control for the skater than the conventional drag style of brakes. The heat generated by braking is dissipated more in the brake arms 23 than in the brake ring. Since the brake arm is pinned to the frame, it is less sensitive to heat than is the wheel.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A brake assembly for in-line skates, said skates having a boot portion supporting a wheel frame which supports a plurality of wheels, said brake assembly comprising:

a movable brake arm supported by said wheel frame and movable between a free running position and a braking position;

at least one braking wheel rotatingly supported by said wheel frame, said braking wheel having a rotating brake ring held by said wheel, said rotating brake ring having a radially outwardly facing circular brake contact surface positioned so that it is contacted by a friction area of said movable brake arm when the movable brake arm is in a braking position and wherein said contact surface of said rotating brake ring has a brake pad surface thereon and wherein said circular brake contact surface and said friction area of said movable brake arm are shaped, as viewed in a vertical cross-section taken facing forwardly with respect to said wheel frame, to prevent relative horizontal movement between said circular brake contact surface and said friction area of said movable brake arm when in said braking position.

2. The brake assembly of claim 1 wherein the shape of a cross-sectional view of the brake contact surface on said rotating brake ring is concave and the shape of a cross-sectional view of the friction area of said brake arm is convex.

3. The brake assembly of claim 1 wherein the shape of a cross-sectional view of the contact surface on said rotating brake ring is convex and the shape of a cross-sectional view of the friction area of said brake arm is concave.

4. The brake assembly of claim 1 wherein the braking wheel has an injection molded polymeric hub and said rotating brake ring is fabricated from a different material than said injection molded polymeric hub and said brake ring being molded in said injection molded polymeric hub and a tire member is molded into contact with at least one of said injection molded polymeric hub and said rotating brake ring.

5. The brake assembly of claim 1 wherein said rotating brake ring has a second radially outwardly facing circular brake contact surface on a side of said braking wheel opposite from that of said outwardly facing circular brake contact surface and said brake assembly has a second movable brake arm positioned to be moved into contact with said second radially outwardly facing circular brake contact surface.

6. A brake assembly for in-line skates, said skates having a boot portion supporting a wheel frame which supports a plurality of wheels, said brake assembly comprising:

a movable brake arm supported by said wheel frame and movable between a free running position and a braking position, said movable brake arm having a brake arm friction area;

at least one of said plurality of wheels being a braking wheel rotatingly supported by said wheel frame, said braking wheel having a rotating brake ring held by said braking wheel, said rotating brake ring having a radially outwardly facing circular brake contact surface positioned so that it is contacted by said brake arm friction area when the movable brake arm is in a braking position and wherein said radially outwardly facing circular brake contact surface has a shaped guide thereon, as viewed in a vertical cross-section taken facing forwardly with respect to said wheel frame and said movable brake arm has a mating shaped friction area, also as viewed in a vertical cross-section taken facing forwardly with respect to said wheel frame to prevent relative horizontal movement between said circular brake contact surface and said friction area of said movable brake arm when in said braking position, whereby the lateral position of the brake arm friction area is directed by contact with the rotating brake ring when the movable brake arm is in a braking position.

7. The brake assembly of claim 6 wherein the shape of a cross-sectional view of the brake contact surface on said rotating brake ring is concave and the shape of a cross-sectional view of the friction area of said brake arm is convex.

8. The brake assembly of claim 6 wherein the shape of a cross-sectional view of the brake contact surface on said rotating brake ring is convex and the shape of a cross-sectional view of the friction area of said brake arm is concave.

9. The brake assembly of claim 6 wherein the braking wheel has an injection molded polymeric hub having said rotating brake ring fabricated from a different material than said injection molded polymeric hub and said brake ring being molded in said injection molded polymeric hub and a tire member is molded into contact with at least one of said injection molded polymeric hub and said rotating brake ring.

10. The brake assembly of claim 9 wherein said rotating brake ring is fabricated from a friction inducing material and said movable brake arm is fabricated with a steel friction area.

11. The brake assembly of claim 6 wherein said rotating brake ring has a second radially outwardly facing circular brake contact surface on a side of said braking wheel opposite from that said outwardly facing circular brake contact surface and said brake assembly has a second movable brake arm positioned to be moved into contact with said second radially outwardly facing circular brake contact surface.

* * * * *